US005838096A

United States Patent [19]

Shinada et al.

[11] Patent Number: 5,838,096

[45] Date of Patent: Nov. 17, 1998

[54] CATHODE HAVING A RESERVOIR AND METHOD OF MANUFACTURING THE SAME

[75] Inventors: Hiroyuki Shinada, Choufu; Satoru Fukuhara, Hitachinaka; Katsuhiro Kuroda, Hachiouji, all of Japan

[73] Assignee: Hitachi, Ltd., Tokyo, Japan

[21] Appl. No.: 679,727

[22] Filed: Jul. 12, 1996

[30] Foreign Application Priority Data

Jul. 17, 1995 [JP] Japan ..... 7-179802

[51] Int. Cl.[6] ..... H01J 1/15

[52] U.S. Cl. ..... 313/336; 313/346 R; 313/311; 313/351; 313/345; 313/309

[58] Field of Search ..... 313/336, 346 R, 313/311, 351, 341, 345, 355

[56] References Cited

U.S. PATENT DOCUMENTS

| | | | |
|---|---|---|---|
| 3,356,887 | 12/1967 | Heil et al. | 313/336 X |
| 3,814,975 | 6/1974 | Wolfe et al. | 313/336 |
| 4,055,780 | 10/1977 | Kawai et al. | 313/336 X |
| 4,143,292 | 3/1979 | Hosoki et al. | 313/336 |
| 4,210,988 | 7/1980 | Turnbull et al. | 29/25.15 |
| 4,258,283 | 3/1981 | Brunger et al. | 313/336 |
| 5,449,968 | 9/1995 | Terui et al. | 313/336 X |
| 5,536,944 | 7/1996 | Tsunoda et al. | 313/336 X |
| 5,616,926 | 4/1997 | Shinada et al. | 313/336 X |

FOREIGN PATENT DOCUMENTS

| | | |
|---|---|---|
| 0068111 | 1/1983 | European Pat. Off. . |
| 0732720 | 9/1996 | European Pat. Off. . |
| 0676731 | 3/1994 | Japan . |

*Primary Examiner*—Ashok Patel
*Attorney, Agent, or Firm*—Antonelli, Terry, Stout & Kraus, LLP

[57] ABSTRACT

A cathode includes a hairpin type filament made of a refractory metal such as W, Mo or Re; a single crystal needle, made of a refractory metal such as W, Mo or Re joined to the filament; and a reservoir formed by applying a slurry of a powder of a metal or metal compound and an organic solvent containing nitrocellulose in the vicinity of a junction between the single crystal needle and the filament. The powder for a reservoir is made of a metal lower than the single crystal needle in a work function or electron affinity, such as Ti, Zr, Hf, Y, Th, Sc or Se, or a compound thereof.

8 Claims, 3 Drawing Sheets

FIG. 4

| Characteristics / Solvents | Mechanical Strength | Time Required for Normal Electron Emission after Sintering and Subsequent Voltage-Application |
|---|---|---|
| Nitrocellulose + Butyl acetate | ○ | Less than 1 hour |
| Nitrocellulose + Amyl acetate | ○ | Less than 1 hour |
| Water | × | 2 to 6 hours |
| Amyl acetate | × | 2 to 6 hours |
| Thinner | × | 2 to 6 hours |
| Methyl methacrylate + Acetone | ○ | More than 48 hours |

○ : Sufficient

× : Not sufficient

CATHODE HAVING A RESERVOIR AND METHOD OF MANUFACTURING THE SAME

BACKGROUND OF THE INVENTION

The present invention relates to an electron source used for electron beam application apparatuses such as an electron microscope and an electron lithography system, and particularly to a cathode exhibiting high brightness, long life, high stability and also excellent manufacturing yield, and a method of manufacturing the cathode.

A $LaB_6$ thermal electron source or a W <310> field emitter has been used as an electron source for electron beam application apparatuses such as an electron lithography system and a scanning electron microscope. In recent years, however, an electron source called "Schottky cathode" has come to be used, which is higher in brightness than the $LaB_6$ thermal electron source, easier in handling than the W <310> field emitter, and stable in electron emission. In such a cathode, a reservoir composed of a metal such as zirconium or titanium, oxygen and the like is provided on the cathode itself for supplying atoms of a metal, oxygen and the like to a needle-shaped tungsten W <100> single crystal tip by thermal diffusion and forming an adsorbed layer, thereby reducing a work function of the single crystal tip (Japanese Patent Laid-open No. Sho 59-49065 and U.S. Pat. No. 3,814,975). This enables stable electron emission at a high brightness. In the case of using such a cathode, an electric field is applied to the W <100> single crystal tip heated at a temperature of from 1000 to 2000 K., to emit thermally excited electrons having an energy higher than a potential barrier generated by a potential of image force of electron and the electric field and electrons penetrating through the potential barrier. Incidentally, a method of forming a reservoir for supplying atoms of a metal to be adsorbed on the surface of a single crystal tip is disclosed in U.S. Pat. No. 3,814,975 and Japanese Patent Laid-open No. Hei 6-76731 wherein a slurry of a powder of a hydrogen compound and amyl acetate is applied and then sintered by heating in an oxygen atmosphere at a high temperature; and another method is also disclosed in Japanese Patent Laid-open No. Sho 59-49065 wherein an oxide powder is applied and is sintered by heating in a vacuum at a high temperature.

In such a Schottky cathode, the manufacture of a reservoir for supplying atoms of a metal to be adsorbed on the surface of a needle-shaped single crystal tip for emitting electrons requires coating a powder for the reservoir and sintering by heating in vacuum at a high temperature. In fabrication of a reservoir described above, amyl acetate is generally used as a solvent for coating of a powder, and water or an organic solvent such as thinner is also used. Such a solvent, however, is disadvantageous in that the reservoir made of the coated powder becomes brittle after drying and is peeled off before sintering by heating at a high temperature. Moreover, some organic solvents are disadvantageous in that they are not perfectly evaporated after heating at a high temperature and are diffused to the single crystal tip, thus obstructing electron emission therefrom.

SUMMARY OF THE INVENTION

In view of the foregoing, the present invention has been made, and an object of the present invention is to provide a cathode in which a powder for a reservoir is not peeled off by drying of an organic solvent after coating of the powder and the organic solvent is evaporated in a short period of time by heating at a high temperature to thereby eliminate the obstruction of electron emission due to the otherwise remaining organic solvent, and a method of manufacturing the cathode.

To achieve the above object, according to one embodiment of the invention, there is provided a cathode comprising a filament made of a first refractory metal, a single crystal needle of a second refractory metal joined to the filament, a reservoir disposed on at least one of the single crystal needle, the filament and a junction between-the single crystal needle and the filament, wherein the reservoir is fabricated by applying a slurry of a powder and an organic solvent containing nitrocellulose and then by sintering by heating the powder.

To achieve the above object, according to another embodiment of the present invention., there is provided a method of manufacturing a cathode including the steps of: joining a single crystal needle made of a first refractory metal to a filament made of a second refractory metal; applying a slurry of a powder for a reservoir and an organic solvent containing nitrocellulose on at least one of the single crystal needle, the filament and a junction between the filament and the single crystal needle; and sintering the powder for a reservoir by heating in a vacuum.

Preferably, the filament is made of a material selected from a group consisting of W, Mo and Re; the single crystal needle is made of a material selected from a group consisting of W, Mo, and Re; and the powder for the reservoir is made of at least one metal lower than the single crystal needle in work function or electron affinity, such as Ti, Zr, Hf, Y, Th, Sc, Be and La, or a compound powder thereof.

More preferably, the single crystal needle is made of tungsten having a crystal orientation of <100>, and the powder for the reservoir is made of oxide of zirconium.

According to the present invention, in fabrication of a reservoir for supplying atoms of a metal lower in work function to a tip of a single crystal needle by diffusion, a powder for the reservoir, made of a metal or oxide thereof is applied in a slurry state using an organic solvent containing nitrocellulose, so that the powder for a reservoir is strongly secured with nitrocellulose after drying of the organic solvent. The coated powder is thus prevented from being peeled off due to mechanical shock. Also, nitrocellulose is one of explosives and is explosively vaporized at a high temperature so that carbon, hydrogen, nitrogen and the like of nitrocellulose contained in the organic solvent are vaporized by heating at a high temperature for sintering the powder of the reservoir and thereby these impurities are perfectly removed after sintering of the powder. Accordingly, carbon, hydrogen, nitrogen and the like contained in the organic solvent are not diffused and adsorbed on the surface of the single crystal tip of the cathode, thereby preventing obstruction of electron emission due to these impurities.

BRIEF DESCRIPTION OF THE DRAWINGS

In the drawings, which form an integral part of the specification and are to be read in conjunction therewith, and in which like reference numerals designate similar components throughout the figures, in which:

FIG. 4 shows comparison in mechanical strength and time required for normal emission between reservoirs fabricated with various solvents.

DETAILED DESCRIPTION OF THE PREFERRED EMBODIMENTS

Figure 1:
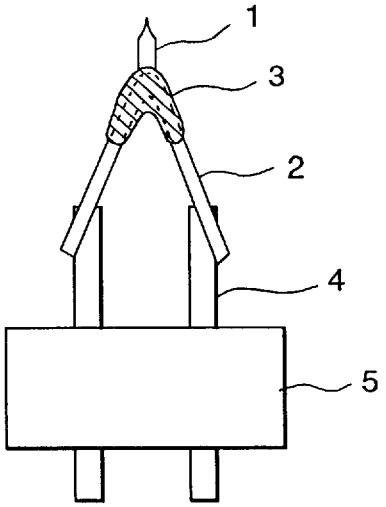
FIG. 1 is a view showing the configuration of a cathode of one embodiment of the present invention.

The structure of a cathode of the present invention and a method of manufacturing the cathode will be described by way of the following embodiment. In the embodiment a single crystal needle is made of tungsten and a reservoir is made of zirconium and oxygen. FIG. 1 shows the configuration of the cathode of the present invention.

A tungsten polycrystal wire having a diameter of 0.15 mm was formed into a filament 2 of a hairpin-like shape. A tungsten single crystal needle having a crystal orientation <100> was joined to the vertex of the central portion of the filament 2, and was then subjected at an end portion thereof to electrochemical etching in a NaOH solution, to form a tip of the single crystal needle 1. On the other hand, a powder of zirconium oxide was added in a solvent of amyl acetate mixed with nitrocellulose in an amount of about 10%, to form a slurry of zirconium oxide. The slurry was applied on a vertex portion of the filament 2, an intermediate portion of the single crystal needle 1, or a base portion of the single crystal needle 1, to form a reservoir 3. Reference numeral 4 indicates a terminal made of stainless steel to which the filament 2 is spot-welded, and reference numeral 5 indicates a ceramic insulator.

Figure 2:
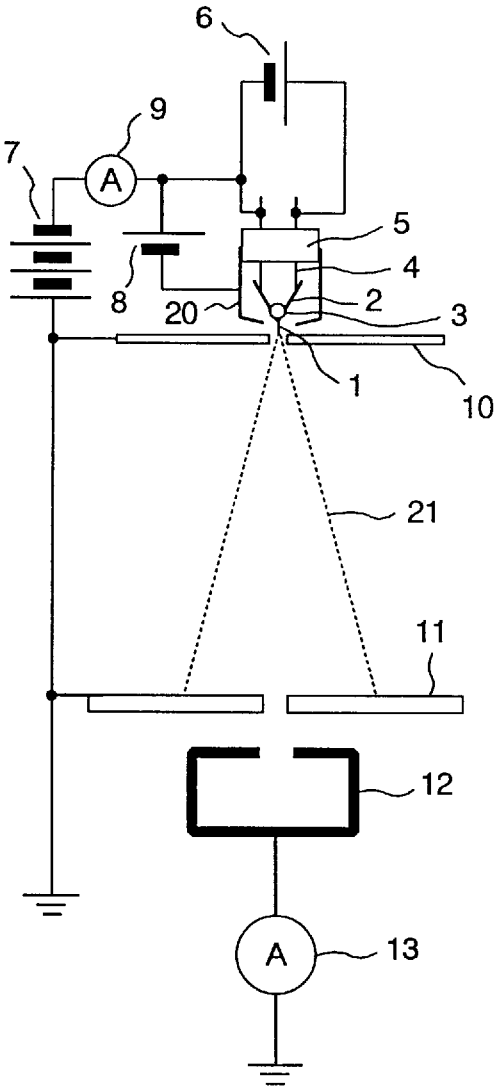
FIG. 2 is a view showing the configuration of an apparatus for fabricating the cathode of the present invention and evaluating characteristics of the cathode.

A powder of zirconium oxide as the reservoir, which was applied as described above, was left to be dried in atmospheric air for several hours, and was then disposed in a high vacuum chamber (not shown) as shown in FIG. 2. FIG. 2 shows the configuration of an apparatus for fabricating a cathode and evaluating characteristics of the cathode. A cathode including the single crystal needle 1, the filament 2 and the reservoir 3 was disposed opposite to an anode electrode 10 such that the cathode was surrounded with a suppressor 20 with only the tip of the single crystal needle 1 projecting therefrom. The suppressor 20 is provided for suppressing unnecessary thermal electrons emitted from portions other than the tip of the single crystal needle 1. A potential negative with respect to the single crystal needle 1 and the filament 2 was applied from a suppressor power supply 8 to the suppressor 20. On the other hand, a potential positive with respect to the single crystal needle 1 was applied from a high-voltage extraction power supply 7 to the anode electrode 10. A current meter 9 for measuring the total current of electrons emitted from the single crystal needle 1 is connected in series to the extraction power supply 7, and the filament 2 is heated by a current supplied from a heating power supply 6. An electron beam 21 extracted by the anode electrode 10 bombards a phosphor plate 11 coated with phosphor. The phosphor plate 11 has a small aperture at the center, and a Farady cage 12 for measuring a current intensity of the electron beam is placed under the small aperture. The electron beam 21 passing through the small aperture formed at the center of the phosphor plate 11 enters the Farady cage 12, to be measured by the current meter 13.

Next, the starting of the cathode and a procedure for an evaluation experiment will be described.

The filament 2 is heated by a current from the heating power supply 6 for sintering the reservoir 3. At this time, the filament 2 is first heated up to a temperature of about 1000 K. in five minutes or more, and then heated up to about 1800 K. in 30 minutes or more by increasing a heating current gradually. The sintering of the reservoir 3 was thus substantially completed. After that, the extraction power supply 7 is controlled to apply and to gradually increase a high voltage between the filament 2 and the anode electrode 10, then the applied voltage is fixed at about 2 kV. Thus, metal atoms diffuse from the reservoir 3 to the tip of the single crystal needle so that an adsorbed surface having a low work function is formed on the crystal surface (100) of the tip. At this time, the electron emission starts, and the total emission current measured by the current meter 9 gradually increases, and a circular emission pattern shown in FIG. 3 appears on the phosphor plate 11 within about one hour. The electron density of the emitted electron beam was in a range of from 0.05 to 1 mA/sr, depending on the radius of curvature of a longitudinal cross section at the tip of the single crystal needle.

Several tens of cathodes were fabricated in accordance with the above procedure. Each of the cathodes exhibited a normal emission pattern, that is, a circular emission pattern within one hour after sintering of the reservoir 3, and it continued to exhibit stable electron emission. Next, comparative cathodes were fabricated, in which a powder of zirconium oxide was applied using various solvents different from that of the present invention. These comparative cathodes presented problems in that the reservoir 3 was peeled off during setting of them in a vacuum chamber and no electrons were emitted, or that it took 48 hours or more until the electron emission was started after sintering of the reservoir.

Figure 3:
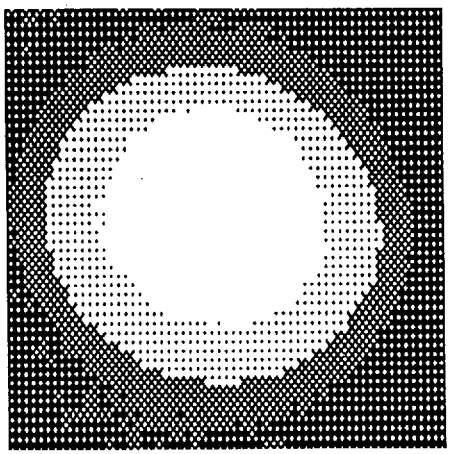
FIG. 3 is a luminous pattern of a phosphor plate when a normal electron emission from a cathode is obtained.

The results are summarized in FIG. 4. In addition, the mechanical strength as one of the evaluated items in FIG. 4 was measured as follows. A cathode having a reservoir made of zirconium oxide dried in atmospheric air for several hours after its application, was fixed in a metal case. The metal case was then dropped from a height of 5 cm onto a concrete floor for examining the possible peeling-off of the reservoir. In addition, a circular emission pattern as shown in FIG. 3 was taken as a criterion for judging whether or not normal electron emission was obtained. The results showed that the samples reservoirs of which were not peeled-off in the drop test were those using a solvent of (nitrocellulose+amyl acetate), a solvent of (nitrocellulose+butyl acetate), and a solvent of (methyl methacrylate+acetone). The solvents of (nitrocellulose+amyl acetate) and (nitrocellulose+butyl acetate) are usually called "collodion". On the other hand, with respect to time required for start of normal electron emission after sintering, it was shortest for the sample using the collodion. It took 48 hours or more for the sample using the solvent of (methyl methacrylate+acetone).

As described above, it was revealed that the sample in which a powder of zirconium oxide was applied using the so-called collodion (an organic solvent containing nitrocellulose) was significantly improved in strength before sintering, and was also shortened in time required for start of electron emission-after sintering.

In the above example, a powder of zirconium oxide was used as a reservoir; however, the present invention is not limited thereto. A powder or compound powder of metal lower than the single crystal needle in work function or electron affinity can be used as a reservoir. For example, it was confirmed that a cathode including a reservoir made of a compound powder of Ti, Zr, Hf, Y, Th, Sc, Be or La was improved in strength to the extent comparable to the case of using zirconium oxide and also shortened in time required for start of electron emission after sintering.

As described above, in the cathode and the method of manufacturing the same according to the present invention, a powder for a reservoir is applied in a slurry state using an organic solvent containing nitrocellulose, so that there can be obtained a cathode high in a resistance against mechanical shock during fabrication, shortened in a period of time required for fabrication, excellent in manufacturing yield, and stable in electron emission.

What is claimed is:

1. A cathode comprising:

a filament made of a first refractory metal;

a single crystal needle made of a second refractory metal joined to said filament; and a reservoir disposed on at least one of said single crystal needle, said filament and a junction between said single crystal needle and said filament, said reservoir being formed by applying a slurry of (a) a powder selected from the group consisting of metal powder and metal compound powder, and (b) an organic solvent containing nitrocellulose.

2. A cathode according to claim 1, wherein said filament is made of a material selected from a group consisting of W, Mo and Re, said single crystal needle is made of a material selected from a group consisting of W, Mo, and Re; and said powder for a reservoir is a powder or compound powder of a metal lower than said single crystal needle in work function or electron affinity.

3. A cathode according to claim 2, wherein said single crystal needle is tungsten having an orientation of <100>, and said powder for a reservoir is made of oxide of zirconium.

4. A cathode according to claim 1, wherein said filament is made of a material selected from a group consisting of W, Mo and Re; said single crystal needle is made of a material selected from a group consisting of W, Mo, and Re; and said powder for a reservoir is made of at least one metal selected from a group consisting of Ti, Zr, Hf, Y, Th, Sc, Be and La, and compounds thereof.

5. A cathode according to claim 1, wherein said reservoir is a reservoir formed by sintering said powder, after applying said slurry, by heating the powder.

6. A cathode according to claim 1, wherein said solvent contains nitrocellulose and one of butyl acetate and amyl acetate.

7. A cathode comprising:

a filament made of a refractory metal;

a tungsten single crystal needle having an orientation of <100>, joined to said filament; and a reservoir disposed on at least one of said single crystal needle, said filament and a junction between said single crystal needle and said filament, said reservoir being formed by applying a slurry of a zirconium oxide powder and an organic solvent containing nitrocellulose.

8. A cathode according to claim 7, wherein said reservoir is a reservoir formed by sintering said powder, after applying said slurry, by heating the powder.

* * * * *